US006329329B1

(12) United States Patent
Sharp et al.

(10) Patent No.: US 6,329,329 B1
(45) Date of Patent: Dec. 11, 2001

(54) LUBRICATED METAL WORKPIECE AND METHOD

(75) Inventors: Joanna Mary Sharp, Wilmslow; William Francis Marwick, Ilkley; Alan Robert Carr, Northants; Peter Geoffrey Sheasby, Banbury, all of (GB)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/656,293

(22) Filed: Sep. 6, 2000

Related U.S. Application Data

(63) Continuation-in-part of application No. 08/867,272, filed on Jun. 2, 1997, now abandoned, which is a continuation-in-part of application No. 08/718,355, filed on Nov. 27, 1996, now abandoned, which is a continuation of application No. 08/411,765, filed as application No. PCT/GB95/00829 on Apr. 12, 1995, now abandoned.

(30) Foreign Application Priority Data

Oct. 1, 1992 (GB) ..... 9220719
Apr. 12, 1994 (EP) ..... 94302557

(51) Int. Cl.[7] ..... C10M 129/70
(52) U.S. Cl. ..... 508/485; 508/501; 508/503; 72/42
(58) Field of Search ..... 508/485, 503, 508/501; 72/42

(56) References Cited

U.S. PATENT DOCUMENTS

| | | | |
|---|---|---|---|
| 3,468,701 | 9/1969 | Hughes . | |
| 3,850,827 | 11/1974 | Zipf | 508/485 |
| 3,923,671 | 12/1975 | Knepp | 508/503 |
| 4,113,635 | 9/1978 | Sakurai . | |
| 4,191,658 | 3/1980 | Jahnke . | |
| 4,812,248 | 3/1989 | Marwick | 252/56 R |
| 4,869,764 | 9/1989 | Marwick | 156/196 |
| 4,950,415 | 8/1990 | Malito . | |
| 5,069,806 | 12/1991 | Trivett . | |

FOREIGN PATENT DOCUMENTS

| | | |
|---|---|---|
| 1644871 | 9/1970 | (DE) . |
| 0227360 | 7/1987 | (EP) . |
| 0276568 | 8/1988 | (EP) . |
| 1485858 | 6/1966 | (FR) . |
| 62127237 | 6/1987 | (JP) . |

OTHER PUBLICATIONS

Aldrich Chemical Catalog, 1992.

*Primary Examiner*—Margaret Medley
*Assistant Examiner*—Cephia D. Toomer
(74) *Attorney, Agent, or Firm*—Cooper & Dunham LLP

(57) ABSTRACT

A lubricant is provided which has a hardness in the range 0.1–10 N/mm at all temperatures in the range 15–40° C. The lubricant consists of at least one full ester of a glycol with a fatty acid, e.g. ethylene glycol dilaurate, optionally mixed with a minor amount of a fatty acid such as stearic acid, and/or a minor amount of a partial ester of a glycol with a fatty acid. The lubricant is useful in the production of press-formed components, and particularly in techniques for converting aluminium sheet to adhesively bonded aluminium structures.

30 Claims, 4 Drawing Sheets

LUBRICATED METAL WORKPIECE AND METHOD

CROSS REFERENCE TO RELATED APPLICATIONS

This application is a continuation-in-part of copending U.S. patent application Ser. No. 08/718,355 now abandoned (filed Nov. 27, 1996, as the US national stage of international application PCT/GB95/00829 filed Apr. 12, 1995) and of the copending Continued Prosecution Application of U.S. patent application Ser. No. 08/867,272 filed (Apr. 12, 1999, as a continuation of U.S. patent application Ser. No. 08/411,765, now abandoned, which was filed May 15, 1995, as the US national stage of international application PCT/GB93/02050 filed Oct. 1, 1993). The entire disclosures of the aforesaid applications Ser. Nos. 08/718,355 and 08/867,272 are incorporated herein by this reference.

BACKGROUND OF THE INVENTION

This invention relates to lubricated metal workpieces, particularly of steel and aluminium, used in the production of press-formed components, and in particular to a method of using such workpieces to make structures of shaped components.

There is current interest in techniques for producing adhesively bonded structures of shaped aluminium components for use in the automotive industry. Such a technique is described for example in EPA 127343. The technique of converting a coil of aluminium metal sheet into a structure of shaped components for use in the automotive industry may typically involve the following steps.

The metal surface is pre-treated to provide a strongly bonded layer thereon which acts as a base for subsequently applied adhesive.

A lubricant is applied to the treated metal coil. The coil may then be stored or transported, with the lubricant serving to protect the treated metal surface, and is cut up into pieces ready for press-forming.

The pieces of metal sheet are press-formed into components of desired shape. This and subsequent operations are all performed on an automobile production line.

Adhesive is applied to selected areas of the shaped components, without first removing the lubricant.

The components are assembled into the shape of the desired structure, and may be spot welded or otherwise fixed to hold the structure together until the adhesive is cured.

The adhesive is cured at elevated temperature.

The metal surfaces of the structure are subjected to an aqueous alkaline cleaner which removes the lubricant The structure is painted.

Alternatively, the press-formed components may be secured together to form the structure by mechanical means, e.g. by rivets or spot welds, either in addition to or instead of adhesive bonding.

A lubricant for use in such a technique needs to fulfil several requirements:

a) The lubricant must, obviously, have suitable lubricating properties for the press-forming operation.

b) The lubricant should be solid at likely metal storage temperatures in order to prevent stacked sheets from sticking together. Furthermore, a film of lubricant that is liquid or sticky is prone to smear and to pick up dust and dirt.

c) Since it is not practicable in a production line to remove lubricant prior to application of adhesive, the lubricant needs to be compatible with an adhesive if one is to be used.

d) After the adhesive has been applied and cured, the lubricant must be readily removable by an aqueous alkaline cleaner of the type conventionally used to prepare metal surfaces for painting.

The lubricants of EPA 227360 are designed to be useful, not only for the technique described above, but also for other forming and shaping operations performed on a variety of metals.

In one aspect, EPA 227360 provides a lubricating composition for press forming consisting of a lubricant dissolved or dispersed in a volatile liquid medium, wherein the lubricant comprises at least one ester of a polyhydric alcohol having two or three hydroxyl groups of which one or two are esterfied with a long chain carboxylic acid and has a melting point above ambient temperature but low enough to permit removal from a metal surface by an aqueous alkaline cleaner.

EPA 227360 mentions that mixtures of esters may be used and may be advantageous; and that the lubricant may contain a minor proportion up to 50% of one or more other lubricating compounds such as long-chain carboxylic acids. The lubricants exemplified are: diethylene glycol monostearate in solution in xylene; and diethylene glycol distearate in solution in xylene.

Although the lubricants described in EPA 227360 are generally successful at meeting requirements c) and d), they are sometimes less successful at meeting requirements a) and b). It is surprisingly found that lubricants of this kind are ineffective, so far as aluminium forming operations are concerned, at temperatures above their liquidus. For good aluminium lubricating properties, in ester lubricants of this kind, it appears necessary that some component be present in the solid state, so that the lubricant is solid or at least mushy or viscous, at the forming temperature which may be as high as 35° C. or 40° C. or even higher.

It might appear a simple matter to solve this isolated problem by using a different ester with a higher melting point. A difficulty with this strategy is that higher melting esters tend to be relatively hard at low and ambient temperatures, to the extent that they readily spall and flake off metal surface to which they are applied. Metal forming at 15 or 20° C. cannot satisfactorily be performed under conditions where the lubricant flakes off the metal workpiece. For use in various parts of the world, there is a need for a single lubricant system which meets both these high- and low-temperature criteria. It is an object of this invention to meet that need.

SUMMARY OF INVENTION

In one aspect the invention provides lubricated metal, wherein a surface of the metal carries a film of a lubricant which a) consists essentially of a full ester of a dihydroxy compound with a $C_8$–$C_{18}$ saturated carboxylic acid in admixture with a minor amount of the mono-ester of said compound optionally in admixture also with at least one long chain carboxylic acid and b) has a hardness in the range 0.2–10 N/mm at all temperatures in the range 15–30° C., preferably in the range 0.1–10 N/mm at all temperatures in the range 15–35° C.

In another aspect, the present invention provides a method of making a structure of shaped aluminium components starting from lubricated aluminium metal sheet as defined, comprising the steps:

forming pieces of the sheet into components, bringing the components together in the shape of the desired structure, and securing the components together by mechanical and/or adhesive means.

Hardness of the lubricant is measured by a technique whereby a block of the lubricant is equilibrated at a given temperature and is penetrated by a steel needle. The test procedure used essentially involves driving a pointed 12 mm diameter needle into the lubricant at a speed of 20 mm/minute, achieved with the use of a materials testing machine such as an Instron and recording the load as a function of the needle penetration into the lubricant. Separate tests are conducted at various temperatures to derive the full curves. The hardness value quoted is then found as the slope of the graph of penetration load versus penetration distance.

Although forming, e.g. press-forming, of metal sheet is generally performed at temperatures in the range 15–30° C. or 35° C., in some tropical locations temperatures in the press may rise to 40° C. or even 45° C. It is therefore preferred that lubricant films of this invention have specified hardness values at temperatures within the range 15–40° C., in the case of particularly preferred lubricants, within the range 15–45° C.

If the lubricant film is too hard, it is likely to be brittle and have poor frictional characteristics during forming e.g. press-forming. If the lubricant film is too soft, then again the lubricating characteristics are inferior. Preferably, the lubricant film has a hardness in the range 0.1–5 N/mm at all temperatures within the range specified at which forming e.g. press-forming is likely to take place in different parts of the world. It is surprising that the hardness of the lubricant film has useful predictive value for its lubricating characteristics.

The major component of the lubricant film is a full ester of a dihydroxy alcohol with a long-chain carboxylic acid. Dihydric alcohols having two carbon atoms are particularly suitable, that is ethylene glycol; and the long chain carboxylic acid is preferably lauric acid. The di-ester is used in admixture with a minor amount of the mono-ester of the same alcohol and carboxylic acid Optionally, the full and partial ester mixture is used in further admixture with a long chain saturated straight chain carboxylic acid having 12 to 18 carbon atoms in the chain. Stearic acid is particularly suitable. For subsequent purposes in this specification the terms EGDL maybe used for ethylene glycol di-laurate and EGML for ethylene glycol mono-laurate.

The full ester or esters may be used optionally in admixture with a minor amount of at least one long-chain carboxylic acid, preferably a saturated straight-chain monocarboxylic acid having from 14–20 carbon atoms in the chain. This optional minor component is present in an amount of less than 50% most usually 5–20%, by weight on the weight of the mixture. A particularly preferred fatty acid is stearic acid.

The full ester or esters may be used preferably in admixture with a minor amount of at least one partial ester of a polyhydric alcohol with a long-chain carboxylic acid. Dihydric or trihydric alcohols are suitable, for example ethylene glycol, propylene glycol, diethylene glycol and glycerol. The long chain carboxylic acid is preferably a saturated straight-chain monocarboxylic acid having from 12–18 carbon atoms in the chain, such as lauric, palmitic or stearic acid. Mixtures of partial esters may be used and may be advantageous. Particularly preferred partial esters are ethylene glycol monolaurate (EGML) and propylene glycol monostearate.

The full esters should be present in the lubricant mixture at a concentration of 40–100 wt %. Preferably the lubricant consists of 50–85 wt % of a full ester such as EGDL, 10–30 wt % of a partial ester such as EGML and up to 20% e.g. 5–20 wt % of a fatty acid such as stearic acid. Lubricant composition can drift during storage, resulting in a somewhat different composition on the lubricated metal surface, and these figures refer to the lubricant when freshly made. Proportions herein are determined by analysis e.g. by standard techniques involving gas chromatography, mass spectrometry and IR spectrometry; they do not necessarily correspond closely to manufacturers' stated proportions in commercially available materials.

To the best of our belief, there is no single ester of commercial purity which meets the above-stated hardness requirement. These esters are not easy to purify. But to the best of our knowledge and belief, EGDL has a melting point of about 50° C.; and EGML has a melting point in the range 23–25° C.; and mixtures of the two have melting ranges intermediate these two figures.

EGML is made by partially esterifying ethylene glycol with "lauric acid", which is a fraction of coconut oil fatty acids and contains more than 30% by weight of fatty acid material which is not lauric acid. However, an "EGML" material has been prepared specifically for us, using lauric acid containing less than 10% of other fatty acid impurities. This lubricant has a melting point of 43° C. A film of this lubricant has the hardness characteristic of this invention. Its composition, determined by analysis as referred to above, is a mixture of EGDL and EGML within the ranges of relative proportions specified above.

Full esters and partial esters such as EGDL and EGML can have impurities arising from two main sources a) The nominal fatty acid, e.g. lauric acid, is in fact a mixture of saturated long-chain monocarboxylic acids, typically containing more than 30% of acids other than the nominated one. An effect of these contaminating acids is to depress the melting point of the ester. For the purposes of the invention, esters are preferably derived from fatty acids which are at least 80% pure.

b) The ester is derived from a fatty acid mixture which contains ethylenically unsaturated acids. Such impurities make the lubricant less adhesive-compatible and less easy to remove from the metal surface, and are therefore preferably absent or present in amounts below 5% by weight.

Partial esterificiation of a polyhydric alcohol having n hydroxyl groups is effected by reacting a mixture of 1 mole of the polyhydric alcohol with less than n moles of a monocarboxylic acid. This typically results in a mixture containing a substantial proportion of the unchanged polyhydric alcohol, substantial proportions of the or each possible partial ester, and a substantial proportion of the full ester. For example, the result of reacting a mixture of one mole of a glycol with less than 2 moles of a monocarboxylic acid is a mixture containing substantial proportions of the unchanged glycol, the monoester and the diester. These proportions can be altered to some extent by control over the amount of carboxylic acid used and the reaction conditions, but a mixture always results. Solvent and unreacted polyhydric alcohol may be readily removed by volatilizabon.

As noted above, the lubricating characteristics of the lubricant film on lubricated metal according to this invention fall off at both excessively high and excessively low temperature. We have developed a test, which is described below, for measuring lubricating characteristics in terms of a frictional coefficient (mu). This frictional coefficient is preferably below about 0.1 at all temperatures within the range of interest, that is to say 15° C. up to 30° C. or 35° C.

or 40° C. or 45° C. As noted above, the hardness of the lubricant film at any temperature is predictive of its frictional coefficient.

Depending on its intended use, the lubricant may need to be compatible with subsequently applied adhesive. In general, the esters described herein are compatible as a result of being either absorbed or displaced by subsequently applied adhesive without grossly impairing the adhesive bond strength obtainable. By contrast, resinous lubricants and metal soap lubricants are generally not adhesive compatible in this sense.

The lubricant has a melting point above ambient temperature, preferably of at least 30° C., more preferably at least 40° C. This ensures that the lubricant is present as a solid film on the metal substrate, which avoids problems with smearing and blocking during coiling, decoiling, slitting and cutting The use of such a lubricant avoids contamination of the metal surface with a possible adhesive-compatible oil or contaminant and,prevents local build up of lubricant to an undesirably thick layer.

The lubricant melts at a temperature low enough to permit its removal from a metal surface by an aqueous alkaline cleaner, such as is used in automotive production lines to prepare metal parts for painting. The highest practicable temperature for aqueous alkaline cleaners in such circumstances is about 70° C. Lubricants melting below 70° C. and preferably below 65° C. can thus be removed by aqueous alkaline cleaners. Lubricants melting above 70° C. may or may not be removable depending on whether they have chemical groups, e.g. hydroxyl groups, which can react with the alkali to assist removal from the metal surface. Thus for example, a commercially available wax having a melting point of 85° C. and an acid number of 135 to 155 by DIN 53402, was found not to be removable by aqueous alkaline cleaners. A lubricant is deemed removable by aqueous alkaline cleaners if it can be removed by treatment for 2 minutes at 70° C. with a 15% by weight aqueous solution of Ridolene 160 (a silicate-based proprietary cleaner marketed by I.C.I.pIc.)

A further aspect of this invention involves applying the lubricant to the metal in the absence of any volatile solvent or diluent. This avoids the need to evaporate volatile liquid from the lubricant film, and avoids the need to include any surface active agent in the lubricant. It is found that the molten lubricants have satisfactory viscosity for spraying or for application by roller coat. To ensure rapid solidification of the lubricant film, the metal may be pre-cooled. To ensure good adhesion of a uniform film, the metal may be preheated.

Alternatively the lubricant may be dissolved in a volatile solvent for application to the metal. Indeed, very thin films can only be applied from solution. The use of solution permits control of lubricant film thickness to within less than 0.5 g/m$^2$.

The lubricant may be applied to steel or other metals, but is likely to be principally used on aluminium, which term is used to cover the pure metal and alloys in which Al is the major component. A metal surface may carry a strongly-bonded inorganic and or organic pretreatment or primer layer, on the top of which the lubricant is present. Such non-metallic layers are well known, and may be provided for example as chemical conversion coatings or deposited coatings of the no-rinse type, based on chromium, titanium or zirconium; or may be an anodic oxide layer (on Al or Ti) or a siloxane layer. The metal may be in sheet form. The rate of application of lubricant will depend on the intended use, but may typically be in the range of 0.1–10 g/m$^2$, e.g. 0.25–8 g/m$^2$, particularly 1–4 g/m$^2$, for aluminium coil to be formed into adhesively bonded structures.

BRIEF DESCRIPTION OF THE DRAWINGS

Reference is directed to the accompanying drawings in which:

FIG. 4 is for lubricant 2. FIG. 6 is for lubricants

DETAILED DESCRIPTION

Figure 1:
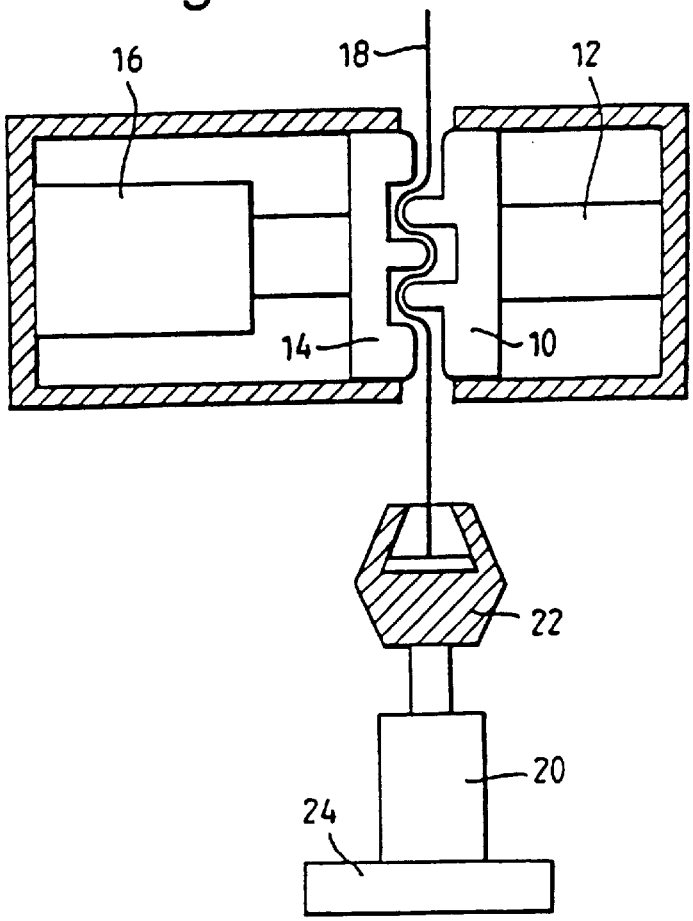
FIG. 1 is a schematic view of a strip-draw apparatus used for testing lubricated metal.
Figure 2:
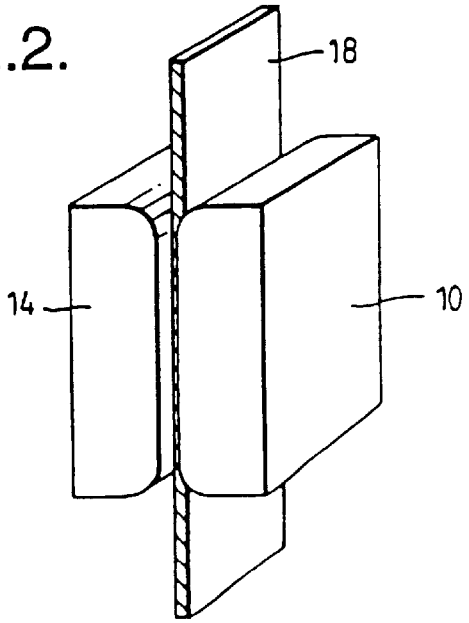
FIG. 2 is a perspective view of a modified strip-draw apparatus.

A purpose built strip-draw rig was designed and constructed with reference to ASTM 4173-82 for testing sheet metal forming lubricants. The apparatus is shown in FIGS. 1 and 2. The die set shown in FIG. 1 was designed to simulate material flowing between pressurised binder surfaces containing a draw bead arrangement. The die set of FIG. 2 was designed to simulate flow between parallel binder surfaces so as to allow conventional frictional values to be obtained.

Referring to FIGS. 1 and 2, one die 10 of each tool set is mounted on a load cell 12. The other die 14 of the tool set is mounted on a hydraulic cylinder 16. Flat strips 18, hydraulically pressurised between the two dies, can then be pulled through a particular tool set while the clamp load is measured. The draw load is also measured using a second load cell 20 mounted between a testing machine gripping jaw 22 and a cross head 24. Thus, when used in conjunction with the flat parallel platen set of FIG. 2, a conventional frictional value is obtained.

The strip draw rig is designed to be mounted on either a press simulator or a standard tensile testing frame, depending on the variables under investigation.

Lubricated strips of material, 50 mm wide, were placed between the two faces of the flat tool set of FIG. 2 and hydraulically pressurised to a particular load. The strips were then drawn through the die set of FIG. 1 for a distance of approximately 250 mm, the draw and clamp forces being recorded as a function of time/displacement of the drawn strip. Results presented in the form of a graph (draw force/2) versus clamp load have a slope equal to the conventional friction coefficient

EXAMPLE 1

A lubricant formulation according to the invention had the composition, in wt %:

61% ethylene glycol dilaurate (EGDL).

19% ethylene glycol monolaurate (EGML)

11% stearic acid

9% other ester species

The identity of the components was determined by standard gas chromatography/mass spectrometry techniques. This formulation is hereinafter called lubricant 1. The combined content of EGDL and EGML in this formulation was a material specifically made for us using 90% plus pure lauric acid, melting point 43° C.

Another lubricant formulation according to the invention had the composition, in wt %:

70% ethylene glycol dilaurate 21.5% ethylene glycol monolaurate 8.5% other ester species The identity of these components also was determined by standard gas chromatography/mass spectrometry techniques. The formulation is hereinafter called lubricant 3.

A formulation called lubricant 2 was made up for comparison. Lubricant 2 contains commercially available EGML 90% and stearic acid 10%. This lubricant fails outside the scope of the present invention, and is included for comparison purposes only.

This commercially supplied ethylene glycol monolaurate has been analysed by us and found to contain seven different acids in proportions as follows: caprylic (C8) 3.9%; capric (C10) 5.8%; lauric (C12) 33%; myristic (C14) 16.8%; palmitic(C16) 11.9%; oleic and stearic (C18) 28%.

Lubricants 1, 2 and 3 were applied by spraying on to aluminium alloy sheets which had been preheated to 50° C. By this means, uniform films could be applied at controlled thickness. The hardness of the lubricants was measured (by the method described above) and the results are recorded in FIG. 3.

Figure 4:
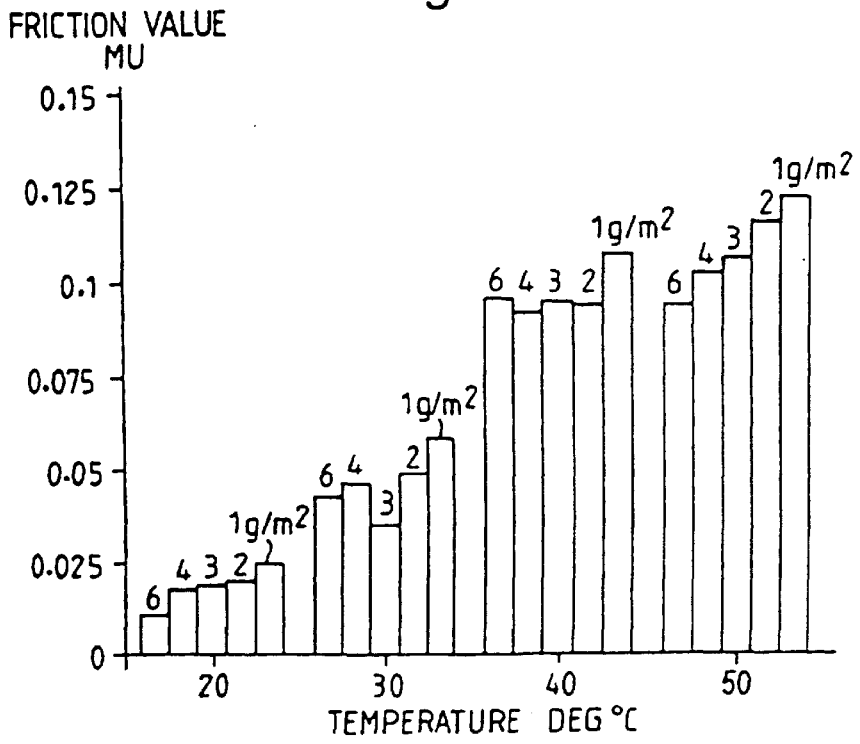
FIGS. 4 and 6 are Bar Charts showing frictional coefficients of two lubricant 1 at different temperatures and different rates of application.
Figure 6:
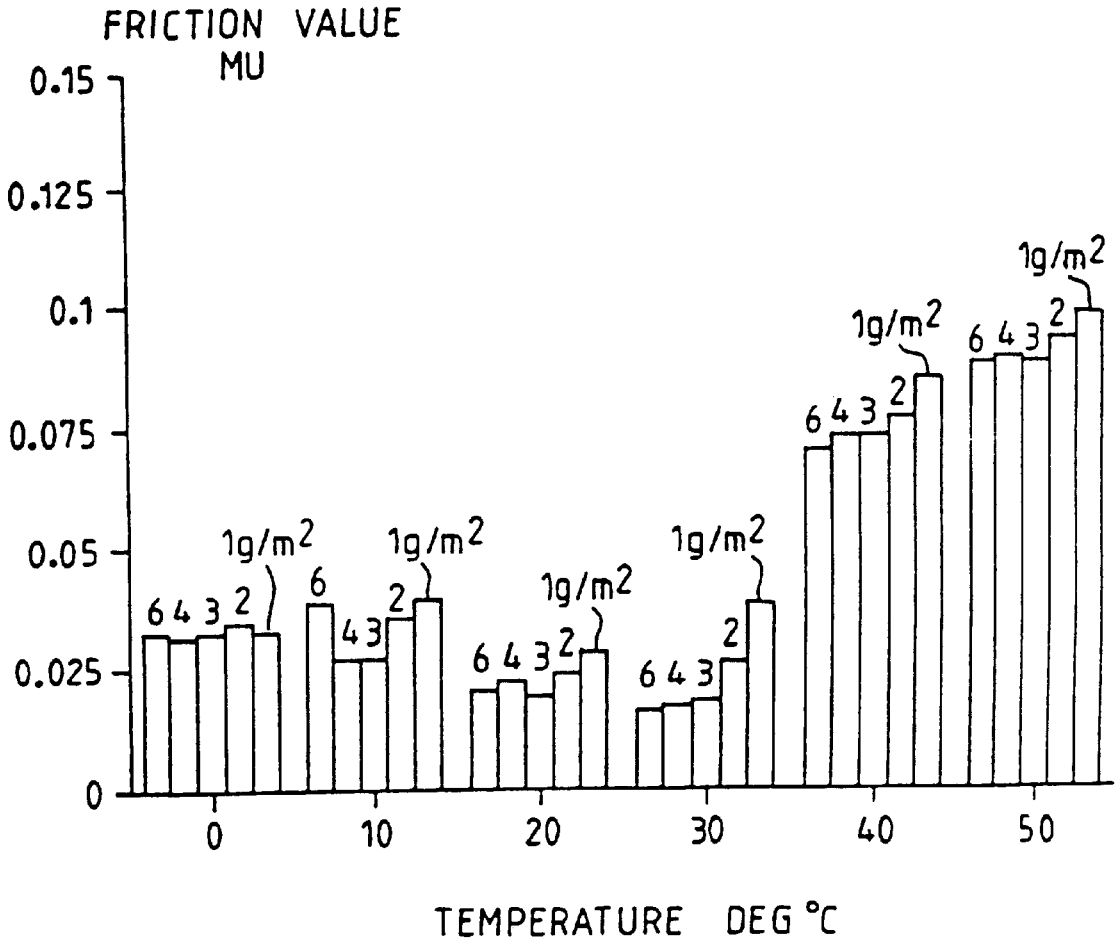

Lubricants 1 and 2 were further tested in the strip draw rig illustrated in FIGS. 1 and 2. In each case, tests were performed at different temperatures in the range 0–50° C.; and at five different rates of lubricant application ranging from 1–6 g/m$^2$. The results of these tests are shown in FIG. 4 (for lubricant 2) and FIG. 6 (for lubricant 1 batch 2, see below).

EXAMPLE 2

Lubricants 1 and 3 from Example 1 were evaluated. Lubricant 2 from Example 1 was used for comparative purposes.

Experimental Procedure

The experimental work described below was carried out on 1.6 mm gauge 5754 material.

2.1 Application of Lubricant to Aluminium Sheets

The procedure for lubricant application consisted of preheating a reservoir of the new lubricant to 70° C., and applying this onto sheets using air-assisted airless spray nozzles. Lubricant was applied to sheets which were held at both room temperature (20° C.), and preheated to 60° C. These sheets were then placed in stacks. In the case of the pre-heated material, the sheets were placed in a stack when the lubricant had solidified.

2.2 Adhesive Compatibility

The standard test method for adhesive compatibility is to assemble standard lap shear joints with a 10 mm overlap, using lubricated 1.6 mm pre-treated coupons and a standard adhesive A string of six such joints are then exposed to combined stress/humidity testing under a constant load. The time to failure of the first three joints in a set of six joints is then noted. Individual lap shear joints are also exposed to salt spray for given periods of time, and then tested for static strength retention.

Tests were carried out on joints manufactured with the lubricant 1 on their surfaces prior to bonding. Two lubricant weight levels were evaluated, namely 2.0 g/m$^2$ and 5.5 g/m$^2$.

2.3 Lubricant Softening as a Function of Temperature

The Wax Penetration Test, was used to determine the softening response as a function of temperature. The test procedure used essentially involves driving a pointed 12 mm diameter needle into the lubricant at a speed of 20 mm/minute, achieved with the use of materials testing machine such as an Instron, and recording the load as a function of the needle penetration into the lubricant. Separate tests are conducted at various temperatures to derive the full curves. The hardness value quoted is then found as the slope of the graph of penetration load versus penetration distance.

2.4 Strip Draw Evaluation

Lubricated sheets were produced with 3 g/m$^2$ of different lubricants via the pre-heated blank route, as indicated in section 2.1. These sheets were guillotined into strips 50 mm wide and then drawn through the strip draw rig, using the described procedure, to allow friction values to be determined at temperatures of 10, 20, 30, 40 and 50° C.

2.5 Press Forming Evaluation of the Lubricant 1

Press forming tests were carried out on a press simulator to evaluate the lubricant Two distinct trials were used, namely:

(a) Square pan depth to failure.

(b) Pressed dome height to failure

The above trials were carried out under standard conditions on a 275 mm square tooling without the draw bead sections.

Sheets of M5754-0 were pressed with 3 g/m$^2$ of both lubricants 1 and 2 to allow the comparative performance to be assessed.

2.6 Simulation of Possible Thermal Cycles of Pre-Lubricated Stacks

In order to simulate possible thermal cycles which may be experienced by pre-lubricated material, lubricated stacks were produced by applying the lubricant to preheated blanks, as described in section 2.1.

Four stacks were produced containing some thirty sheets, each 500×500 mm, with a nominal 3 g/m$^2$ lubricant weight. These stacks were heated to four different temperatures in an oven at, 30, 35, 40 and 45° C. respectively. After removal from the oven, each stack was left to cool with a centrally applied weight of 18.1 kg. After destacking, coupons were removed from a number of adjacent sheets to quantify any lubricant transfer observed.

2.7 Cleaning, Oven Evaporation and Residues

Two distinct tests were carried out in this section, namely different oven bakes followed by a cleaning stage, including no bake, and a typical bonded structure route with the adhesive cure cycle included.

For the first series of tests, pre-treated strips of aluminium were lubricated with lubricant 2 (3.4 g/m$^2$) and lubricant 1 (3.8 g/m$^2$), and given the following treatment:

a) 20 minutes at 170° C.

b) 20 minutes at 180° C.

c) 20 minutes at 190° C.

d) 20 minutes at 200° C.

e) No oven bake.

All strips were then cleaned in stirred 20 g/litre solutions of Chemkleen CK165 at a temperature of 60° C. for 3 minutes. After drying, organic contamination on the strips was measured, as carbon, by analysis at 600° C.

For the second series of tests, clean sheets of aluminium were coated with lubricant 1 and lubricant 2 at a coating weight of approximately 4.5 g/m$^2$. The sheets were then subjected to a cumulative oven-bake and alkali-clean cycle. This consisted of:

a) 10 mins at 145° C.

b) 20 mins at 190° C.

c) 20 mins at 190° C.

d) 30 secs alkali clean, (stirred 2.5% w/w Ridolene 336 at 60° C.).

Final coat weights were measured after the cleaning stage using gravimetric determination.

3. Results

3.1 Application of the Lubricant to the Sheets

Satisfactory results were obtained by spraying the lubricant 1 onto sheets held at both room temperature, approximately 20° C., and sheets pre-heated to 60° C. The lubricant solidified upon contact with the sheets held at ambient temperature. However, the latter condition allowed the lubricant to remain liquid on the sheets for a short time period.

The lubricant itself passed through the spray nozzles without any additional problems to those encountered with the lubricant 2.

3.2 Adhesive Compatibility

The results of stress-humidity and salt spray testing on joints produced with lubricant 1 on their surfaces are presented in Table 1. This Table shows a good strength retention after 20 weeks salt spray, and a testing duration in excess of 100 days during stress-humidity with a 5 MPa applied stress.

3.3 Lubricant Softening as a Function of Temperature

Figure 3:
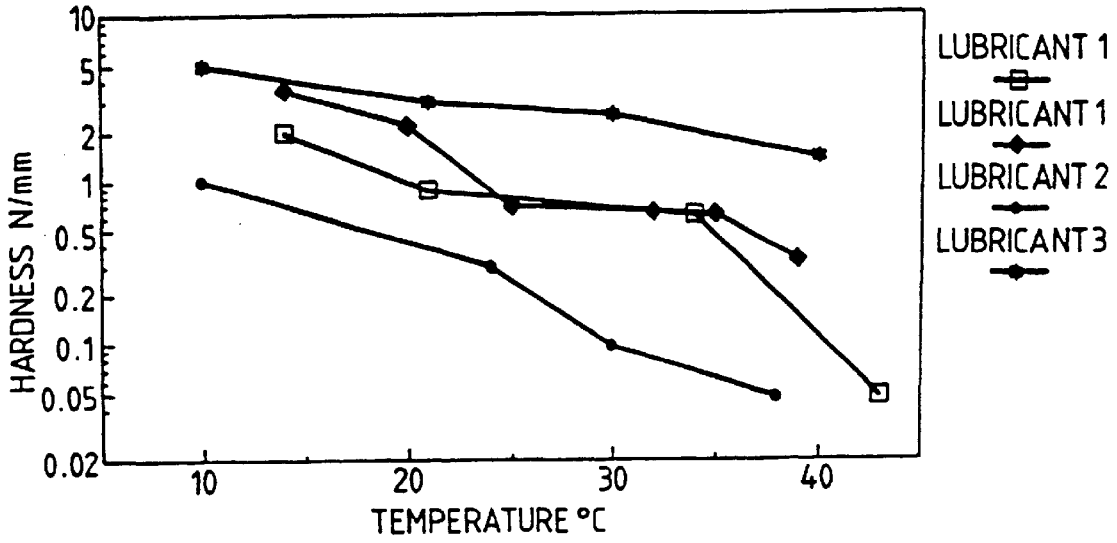
FIG. 3 is a graph of hardness against temperature for several lubricants.

The results of the Wax Penetration Testing carried out on lubricants 1, 2 and 3 are presented in FIG. 3.

Two batches of lubricant 1 were made on separate occasions. Batch 1 is shown by filled diamonds joined by a solid line. Batch 2 is shown by shaded squares joined by a dotted line. Both materials fall within the scope of the invention, as does lubricant 3, shown by stars.

Lubricant 2 is shown for comparison. The hardness was relatively low at all temperatures.

3.4 Strip Draw Evaluation

Table 2 shows the comparative performance of the lubricants 1, 2 and 3 over the measured temperature range for a given lubricant weight of 3 g/m$^2$. These figures show an improved performance of the lubricant 1 batch 1 at temperatures of 30, 40 and 50° C. They also indicate a similar performance at 20° C.

3.5 Press Forming Evaluation of the Lubricant 1

The results of the press forming trials are shown in Table 3. This Table indicates that both lubricants give a similar performance during stretch forming, but an improved performance is obtained during square pan forming with the lubricant 1. The values quoted are the average of five tests in each case. The tests themselves were carried out in ambient conditions of around 22–24° C.

3.6 Simulation of Possible Thermal Cycles of Pre-Lubricated Stacks

Stacks of lubricated sheets, having lubricant 1 on their surface, which were heated to 30, 35 and 40° C. and subsequently cooled with a centrally applied weight showed no evidence of de-stacking problems or lubricant transfer between adjacent sheets. The corresponding stack heated to 45° C. was more difficult to separate, showing clear evidence of a "patchy" appearance, and slight lubricant transfer between adjacent sheets. With the lubricant 2, a similar effect was seen at a temperature of 35° C.

3.7 Cleaning, Oven Evaporation and Residues

Figure 5:
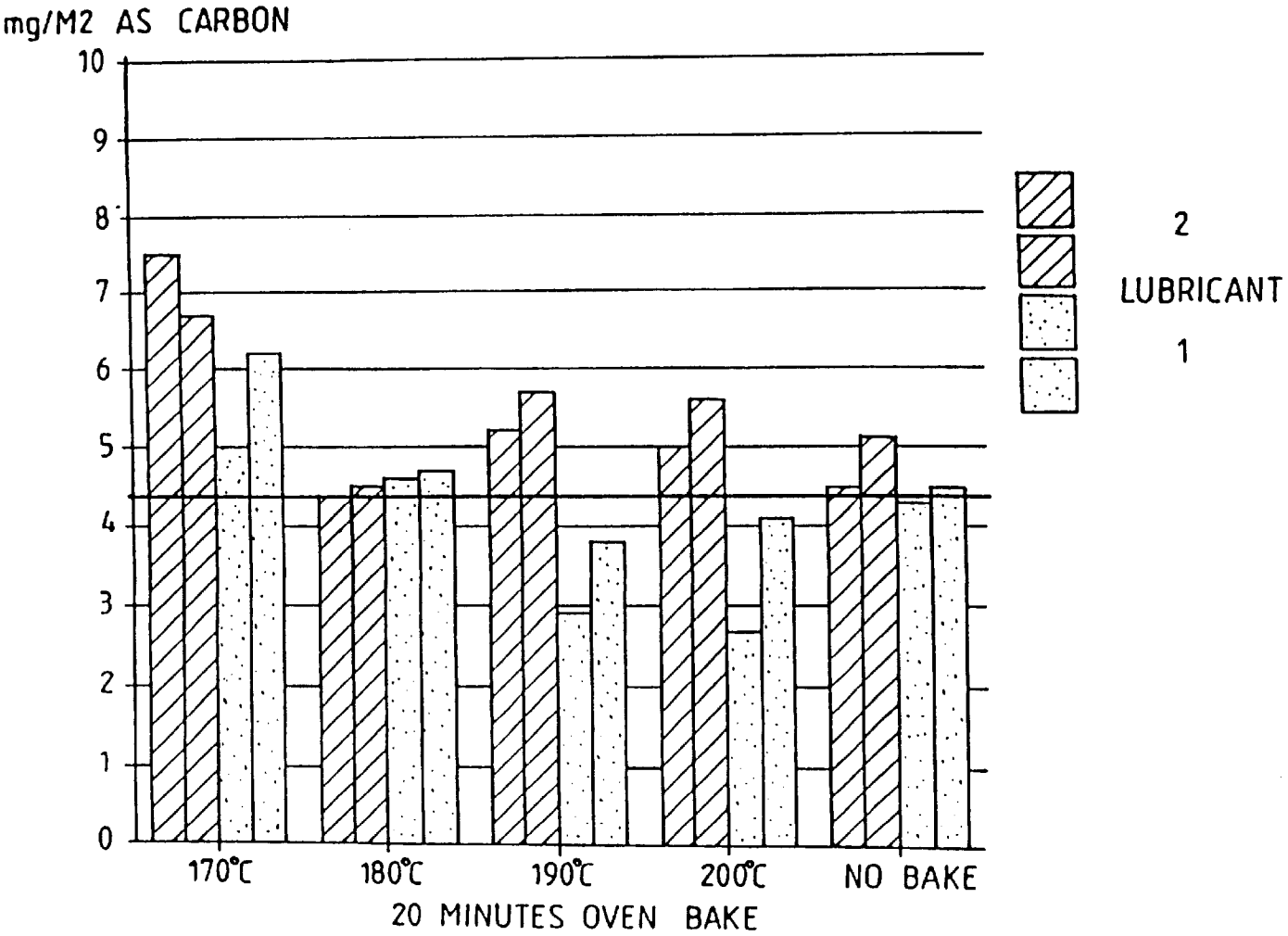
FIG. 5 is a bar chart showing lubricant residues after different bakes followed by cleaning.

The results of the different oven bakes followed by a cleaning stage, including no bake followed by a cleaning stage, are given in FIG. 5. This figure shows that high oven bakes contribute to the surface cleanliness.

The results of the oven evaporation trials show that lubricant 1 evaporates almost totally compared to lubricant 2, 0.03 g/m$^2$ and 0.35 g/m$^2$ residue respectively. Final coat weights were also measured after the final alkali clean using gravimetric determination. The results of both lubricants fell to between −0.01 and −0.03 g/m$^2$ indicating that the cleaning stage is removing all of the residues.

4 Discussion

4.1 Application of the Lubricant to the Sheets

No difficulties were experienced with the spray application of lubricant 1. Adherence to the metal surface was improved by pre-heating the sheets, although a satisfactory appearance was obtained with room temperature metal.

4.2 Adhesive Compatibility

The results of the stress-humidity testing show that joints manufactured with lubricant 1 at a level of 2 g/m$^2$ are still on test, with 190 days achieved to date for all stress levels tested.

Salt spray data after 20 weeks exposure shows excellent strength retention at both lubricant weight levels, outperforming the lubricant 2.

4.3 Lubricant Softening as a Function of Temperature

Results of the Wax Penetration test, presented in FIG. 3, show the hardness improvement over the temperature range examined. Earlier work had suggested that the hardness value should be maintained between 0.1 and 1.0 N/mm on the vertical logarithmic axis. Significantly exceeding the higher hardness values at lower temperatures will produce a wax which is brittle and has limited value in terms of press die forming. At the higher temperatures, hardness values less than 0.1 N/mm correspond to the melting range of the wax. FIG. 3 shows that the hardness of lubricant 1 falls to 0.1 N/mm around 41–42° C. corresponding to its melting range. This is approximately 10–12° C. higher than lubricant 2. Thus the upper melting range has been significantly increased without producing a brittle wax at the lower temperature range. Lubricant 3 has a hardness that is strikingly independent of temperature.

4.4 Strip Draw Evaluation

In terms of frictional performance versus temperature for a lubricant weight of 3.0 g/m$^2$, Table 2, the lubricant 1 demonstrated a significant improvement in the frictional coefficient at 30, 40 and 50° C., whilst having a similar performance at 20° C.

4.5 Press Forming Evaluation of the Lubricant 1

The results of the press forming evaluation indicate that the lubricant 1 formulation has an equal performance during stretch forming, but a somewhat better performance during square pan pressing. This should give an advantage to components such as door rings and door inner pressings, where deep corner features are required having small corner sweep radii. Thus the performance improvement will be beneficial.

4.6 Simulation of Possible Thermal Cycles of Pre-Lubricated Stacks

Results of thermal cycles applied to pre-lubricated stacks have shown no evidence of lubricant transfer at 40° C., and only slight evidence of lubricant transfer when the stack was heated to 45° C. and then cooled. Thus, problems of lubricant transfer with the lubricant 1 will now become apparent at temperatures between 40 and 45° C. This performance is much better than the lubricant 2 where no evidence of transfer was visible when the stack was heated to 30° C., but evidence was visible when the stack was heated to 35° C. Hence a 10° C. temperature improvement in terms of handling performance has been achieved.

4.7 Cleaning, Oven Evaporation and Residues

Trials to assess the cleaning of the surface after either various oven bakes or no bake, FIG. 5, have shown that Chemkleen solution does clean the surfaces reasonably effectively. High oven bake conditions, 190° C. and 200° C., definitely contribute to surface cleanliness in the case of lubricant 1, which evaporates very cleanly from the aluminium surfaces.

Trials to determine the relative evaporation and remaining residues of lubricant 1 versus lubricant 2 have shown that the lubricant 1 evaporates almost completely prior to the cleaning stage. Further, lower levels of carbon residuals are obtained.

TABLE 1

Stress/Humidity and Salt Spray Data for the Lubricant 1

| Lubricant Weight | Stress/Humidity Days to Failure | | | Salt Spray Results (MPa) | | |
|---|---|---|---|---|---|---|
| $g/m^2$ | 3 MPa | 4 MPa | 5 MPa | 0 wks | 8 wks | 20 wks |
| 2.0 | 190+ | 190+ | 190+ | 27.8 | 25.5 (92%) | 25.1 (90%) |
| 5.5 | 190+ | 190+ | 137 | 28.4 | 25.2 (89%) | 23.6 (83%) |

TABLE 2

| | Friction Value at temperature ° C. | | | | |
|---|---|---|---|---|---|
| Lubricant | 10° | 20° | 30° | 40° | 50° |
| 1 | | 0.017 | 0.012 | 0.046 | 0.069 |
| 2 | | 0.020 | 0.036 | 0.096 | 0.107 |
| 3 | 0.092 | 0.020 | 0.043 | nd | nd |

nd - not determined

TABLE 3

Effect of Lubricant on Press Formability

| Lubricant | Coat Weight ($gm^2$) | Square Pan Depth mm+ | Dome Height mm |
|---|---|---|---|
| 2 | 3.0 | 59.1 | 51.5 |
| 1 | 3.0 | 74.3 | 52.0 |

What is claimed is:

1. A method of applying a lubricant to a metal, which method comprises applying a lubricant comprising (in wt %):

| | |
|---|---|
| ethylene glycol dilaurate | 50–85 |
| ethylene glycol monolaurate | 10–30 |
| stearic acid | up to 20, |

as determined by analysis, to a surface of the metal, wherein the lubricant is solid or at least mushy or viscous and does not spall or flake off the metal surface at all temperatures in the range 15–35° C.

2. A method as claimed in claim 1, wherein the lubricant has a hardness in the range 0.1–10 N/mm at all temperatures in the range 15–35° C.

3. A method as claimed in claim 1, further comprising the step of pre-treating the metal surface with a strongly-bonded inorganic and/or organic layer before applying the lubricant.

4. A method as claimed in claim 1, wherein the lubricant is applied at a rate in the range of 0.1–10 $g/m^2$.

5. A method as claimed in claim 3, further comprising the steps of providing a molten lubricant and applying the molten lubricant to the metal.

6. A method as claimed in claim 5, wherein the lubricant is applied by spraying.

7. A method as claimed in claim 5, wherein the lubricant is applied by roll coating.

8. A method as claimed in claim 5, wherein the molten lubricant is applied to a metal which is at room temperature.

9. Lubricant comprising (in wt %)

| | |
|---|---|
| ethylene glycol dilaurate | 50–85 |
| ethylene glycol monolaurate | 10–30 |
| stearic acid | up to 20 |

as determined by analysis, which lubricant (a) consists essentially of (i) esters derived from fatty acids which comprise at least 80% lauric acid and (ii) optionally, stearic acid; and (b) has a hardness in the range 0.1–10 N/mm at all temperatures in the range 15–35° C.

10. Lubricant as claimed in claim 9, wherein said fatty acids contain not more than 5% ethylenically unsaturated acids.

11. Lubricant as claimed in claim 9, consisting essentially of (in wt %)

| | |
|---|---|
| ethylene glycol dilaurate | 50–85 |
| ethylene glycol monolaurate | 10–30 |
| stearic acid | up to 20, |

as determined by analysis.

12. Lubricant as claimed in claim 9, wherein the lubricant has a hardness in the range 0.1–5 N/mm at all temperatures within the range specified.

13. Lubricant as claimed in claim 9, wherein the lubricant has a hardness within the range specified at all temperatures in the range 15–40° C.

14. Lubricant as claimed in claim 9, wherein the stearic acid content is 5–20% by weight.

15. Lubricated metal, wherein a surface of the metal carries a film of the lubricant of claim 9.

16. Lubricated metal as claimed in claim 15, wherein the metal is sheet.

17. Lubricated metal as claimed in claim 15, wherein the metal is aluminium.

18. Lubricated metal as claimed in claim 17, wherein the metal is sheet.

19. Lubricated metal as claimed in claim 17, wherein the aluminium carries a strongly-bonded artificial inorganic surface layer on top of which the film of lubricant is present.

20. A method of making a structure of shaped aluminium components starting from lubricated aluminium metal sheet according to claim 18, comprising the steps of:

i) forming pieces of the sheet into components, ii) bringing the components together in the shape of the desired structure, and iii) securing the components together by mechanical and/or adhesive means.

21. A method of making a structure of shaped aluminium components starting from lubricated aluminium metal sheet according to claim 19, comprising the steps of:

i) forming pieces of the sheet into components, ii) applying adhesive to the components, iii) bringing the components together in the shape of the desired structure, and iv) curing the adhesive.

22. A method as claimed in claim 20, comprising the additional steps of cleaning the structure with an aqueous alkaline cleaner, and thereafter painting the structure.

23. Lubricant comprising (in wt %)

| | |
|---|---|
| ethylene glycol dilaurate | 50–85 |
| ethylene glycol monolaurate | 10–30 |
| stearic acid | up to 20 |

as determined by analysis, which lubricant has a hardness in the range 0.1–10 N/mm at all temperatures in the range 15–35° C.

24. Lubricant comprising (in wt %)

| | |
|---|---|
| ethylene glycol dilaurate | 50–85 |
| ethylene glycol monolaurate | 10–30 |
| stearic acid | up to 20 |

as determined by analysis, which lubricant consists essentially of (i) esters derived from fatty acids which comprise at least 80% lauric acid and (ii) optionally, stearic acid.

25. Lubricant as claimed in claim 23, consisting essentially of (in wt %)

| | |
|---|---|
| ethylene glycol dilaurate | 50–85 |
| ethylene glycol monolaurate | 10–30 |
| stearic acid | up to 20 |

as determined by analysis.

26. Lubricated metal, wherein a surface of the metal carries a film of the lubricant of claim 23.

27. Lubricated metal as claimed in claim 26, wherein the metal is sheet aluminium.

28. Lubricated metal as claimed in claim 27, wherein the aluminium carries a strongly-bonded artificial inorganic surface layer on top of which the film of lubricant is present.

29. A method of making a structure of shaped aluminium components starting from lubricated aluminium metal sheet according to claim 27, comprising the steps of:

i) forming pieces of the sheet into components, ii) bringing the components together in the shape of the desired structure, and iii) securing the components together by mechanical and or adhesive means.

30. A method of making a structure of shaped aluminium components, wherein at least one starting component is lubricated aluminium metal sheet according to claim 27, comprising the steps of:

i) forming pieces of the sheet into components, ii) bringing the components together in the shape of the desired structure, and iii) securing the components together by mechanical and/or adhesive means.

* * * * *